United States Patent [19]

Thuries et al.

[11] Patent Number: 4,992,634

[45] Date of Patent: Feb. 12, 1991

[54] MEDIUM TENSION GAS BLAST CIRCUIT BREAKER

[76] Inventors: Edmond Thuries, Pusignan; Michel Perret, Tramole; Denis Dufournet, Bron, all of France

[21] Appl. No.: 509,831

[22] Filed: Apr. 17, 1990

[30] Foreign Application Priority Data

Apr. 17, 1989 [FR] France ..... 89 05050

[51] Int. Cl.[5] ..... H01H 33/88

[52] U.S. Cl. ..... 200/148 R; 200/148 A; 200/148 B

[58] Field of Search ..... 200/148 R, 148 A, 148 B

[56] References Cited

U.S. PATENT DOCUMENTS 2,957,063 10/1960 Leeds ..... 200/148 R

FOREIGN PATENT DOCUMENTS 3132825 1/1983 Fed. Rep. of Germany .

2576142 7/1986 France .

*Primary Examiner*—Robert S. Macon

[57] ABSTRACT

A medium tension circuit breaker having a dielectric blast gas, the circuit breaker comprising a cylindrical insulating casing filled with dielectric gas under pressure, a fixed main contact, a fixed arcing contact, a fixed blast piston, and moving equipment connected to an operating member and comprising a moving main contact, a moving arcing contact, and a blast cylinder associated with a blast nozzle, wherein the circuit breaker includes a drive piston whose section is not less than 1.3 times the section of the blast piston, the drive piston moving relative to a second cylinder.

7 Claims, 1 Drawing Sheet

MEDIUM TENSION GAS BLAST CIRCUIT BREAKER

The present invention relates to a medium tension circuit breaker in which a gas having good dielectric properties such as sulfur hexafluoride ($SF_6$) is used both for internal insulation of the circuit breaking chamber and also as a means for blasting the arc.

BACKGROUND OF THE INVENTION

Medium tension circuit breakers (i.e. in the range 3 kilovolts to 45 kilovolts) as manufactured at present on the above-indicated principle cannot interrupt currents of more than 25 kiloamps when the operating energy is low (less than 300 joules). However, with the present increase in power being conveyed by medium tension lines, it is becoming necessary to have apparatus available which is capable of interrupting higher currents, e.g. as high as 45 kiloamps to 50 kiloamps.

An object of the present invention is to provide such apparatus.

Another object of the invention is to provide apparatus which is unsophisticated, and therefore relatively cheap to manufacture and to maintain.

Another object of the invention is to provide a circuit breaker that requires little operating energy, so that the cost of its control system is low.

The circuit breaker of the invention is of the type in which the increase in pressure on tripping due to an electric arc appearing between the arcing contacts is made use of to exert a driving force on the moving equipment, thereby applying additional energy to the operating member which therefore does not itself need to be too powerful. In high tension applications, such an arrangement is known, as described, for example, in French Pat. No. 85 00610, in German patent application No. 31 32 825, and in U.S. Pat. No. 2 957 063. In circuit breakers of this type, the increase in pressure which occurs in the vicinity of the arc propagates to a piston connected to the moving equipment and provides additional drive.

The ease and the speed with which pressure propagates depend firstly on the obstacles on the gas flow path between the arcing zone and the piston, and secondly on the way the pressure gradient changes between the arcing zone and the face of the piston.

In the devices described in the above-mentioned documents, the gas propagates along annular ducts whose small section does not encourage rapid flow; in addition, the pressure gradient between the arcing zone and the face of the piston falls off very quickly such that the mechanical action of gas falls off very quickly after the arc has appeared.

In order to mitigate these drawbacks, the invention proposes providing a circuit breaker in which pressure is transmitted quickly to the piston connected to the operating member and in which the flow of gas from the arcing zone takes place quickly and without disturbance.

Another object of the invention is to provide a circuit breaker in which the arc is subjected, when the circuit breaker is opened, to two blasts, one in the moving direction of the moving parts, and the other in the opposite direction.

SUMMARY OF THE INVENTION

The present invention provides a medium tension circuit breaker having a dielectric blast gas, the circuit breaker comprising a cylindrical insulating casing filled with dielectric gas under pressure, a fixed main contact, a fixed arcing contact, a fixed blast piston, and moving equipment connected to an operating member and comprising a moving main contact, a moving arcing contact, and a blast cylinder associated with a blast nozzle, wherein the circuit breaker includes a drive piston whose section is not less than 1.3 times the section of said blast piston, said drive piston moving relative to a second cylinder.

BRIEF DESCRIPTION OF THE DRAWING

An embodiment of the invention is described by way of example with reference to the accompanying drawing, in which.

DETAILED DESCRIPTION

Figure 1:
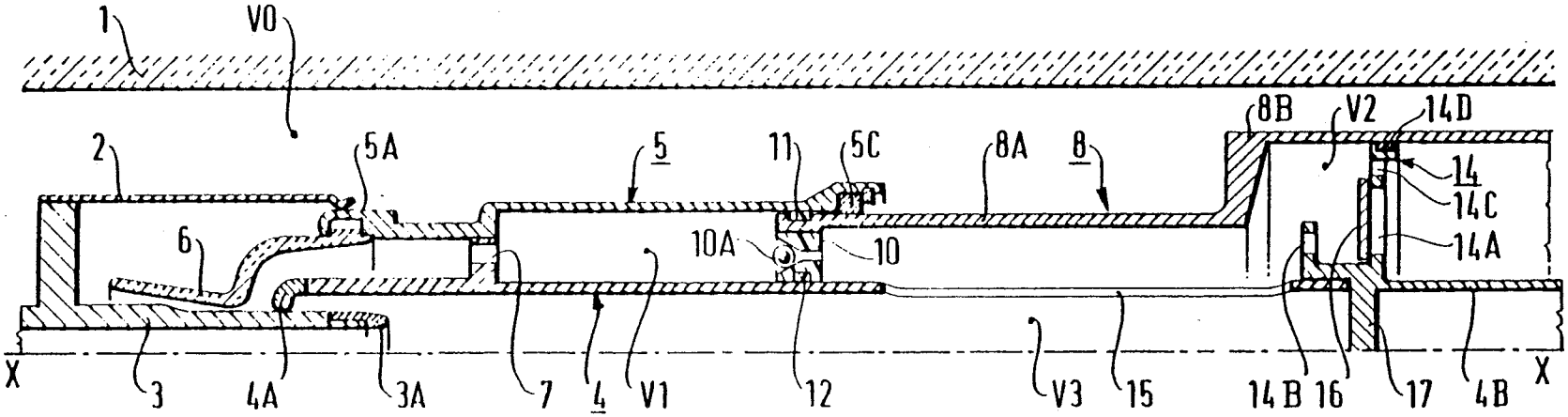
FIG. 1 is a fragmentary axial half-section through a circuit breaker of the invention, shown in the engaged position.

The circuit breaker shown in part in FIG. 1 comprises a casing 1 made of an insulating material such as a ceramic and generally cylindrical in shape about an axis xx, thereby delimiting an inside volume Vo filled with a gas having good dielectric properties, e.g. sulfur hexafluoride ($SF_6$), at a pressure of a few bars.

The circuit breaker is entirely circularly symmetrical about the axis xx and comprises a fixed main contact 2 connected to a first current terminal (not shown) and a fixed arcing contact 3 having one end 3A made of an alloy, such as a tungsten alloy, with withstands the effects of arcing.

The moving equipment of the circuit breaker comprises a tube 4 having one end 4A made of an arc-resistant alloy, and constituting the moving arcing contact. The other end 4B of the tube 4 is connected to an operating device (not shown). The tube 4 is fixed to a tube 5 whose end 5A constitutes the main moving contact of the circuit breaker.

A blast nozzle 6 made of insulating material is fixed to the end 5A, and the throat of the nozzle is obstructed by the arcing contact 4 when the circuit breaker is in the closed position.

Holes 7 are made through the ring interconnecting the tubes 4 and 5 such that these tubes define a single volume V1 which is closed at one end by the nozzle 6.

The tube 5 is guided by a first tubular portion 8A of a metal part 8 having a second tubular portion 8B which is considerably greater in section than the portion 8A.

The part 8 is connected to a second current terminal (not shown).

The tube 5 carries a sliding electric contact 5C which cooperates with the tube 8A.

The volume V1 is closed at its end shown to the right in FIG. 1 by a blast piston 10 fixed to the tube 8A. The piston 10 is provided with a non-return valve 10A which allows gas to pass from the outside towards the inside of the volume V1 only. Sealing rings 11 and 12 seal the piston 10.

In the engaged position of the circuit breaker (FIG. 1), current flows via the parts 2, 5, and 8.

The tube 5 is fixed to a "drive" piston 14 placed inside the tube 8B and capable of sliding inside said tube in sealed manner by virtue of a sealing ring 14D. Together with the tubes 8A and 8B, and the piston 10, the drive piston 14 delimits a volume V2. The drive piston includes a seat provided with openings 14A capable of being closed by an annular non-return valve 16 whose stroke is limited by an abutment 14B.

The section of the drive piston 14 is large relative to that of the blast piston, for example the ratio of their sections is not less than 1.3 and preferably lies in the range 1.5 to 2.

The valve seat also has orifices 14C of calibrated diameter whose function is explained below.

The surface of the tube 14 is pierced by very large openings 15 providing vast intercommunication passages between the volume V2 and the inside volume V3 of the tube 5. The volume V3 is closed at its operating member end by a disk 17 fixed to the tube 4.

The circuit breaker operates as follows:

(1) Interrupting high currents

These are short-circuit currents.

On detecting a short circuit, the operating device of the circuit breaker drives the moving equipment (tubes 4 and 5, nozzle 6, piston 14) to the right in the figure.

The main contacts separate, and the current then flows via the arcing contacts 3 and 4.

Figure 2:
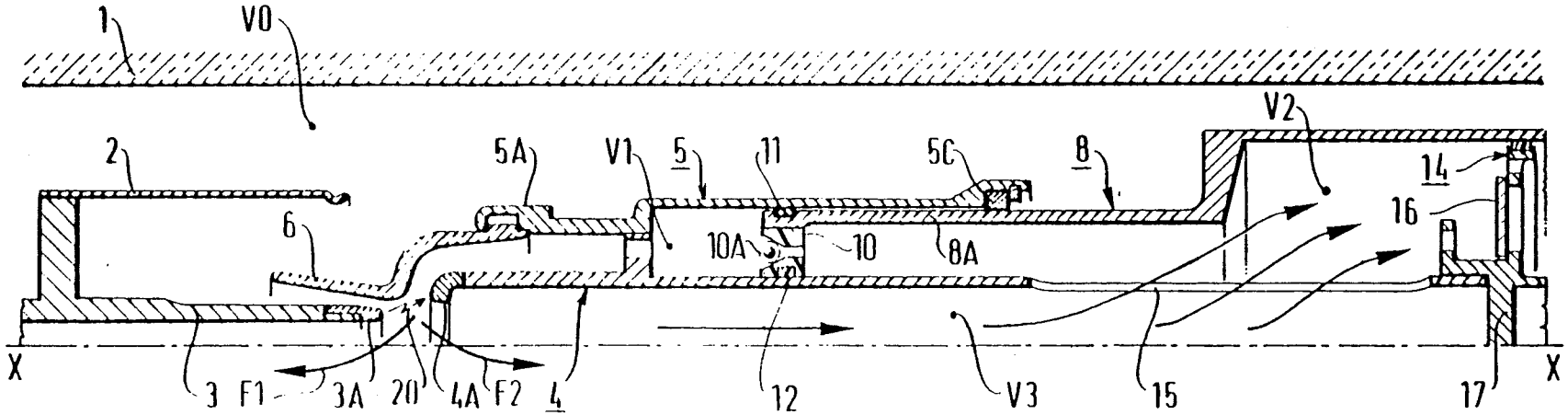
FIG. 2 is a fragmentary axial half-section through the same circuit breaker shown in the middle of a disengagement operation (opening).

When the arcing contacts separate, an arc 20 is struck (FIG. 2). It heats the surrounding gas strongly and pressure increases greatly. The hot gas escapes via the volume V3 and the resulting pressure closes the valve 16. Since the area of the piston is very large, the force exerted thereon which provides assistance to the opening operation is very large. The circuit breaker does not slow down.

The flow of hot gas from the arcing zone is facilitated:

(a) by the large openings 15 which substantially eliminate head losses; and (b) by the calibrated orifices 14C which limit the value of the pressure in the volume V2, thereby ensuring that the pressure falls between the zone of the arc and the zone of the piston 14.

The compressed gas in the volumes V1 and V3 expands on the first zero crossing of the current, thereby extinguishing the arc by virtue of the two blasts along the directions of arrows F1 and F2 in FIG. 2.

(2) Interrupting low currents

Low currents are constituted, for example, by nominal current, or by capacitive currents or by slightly inductive currents.

When the arcing contacts separate, the increase in pressure due to the arc is insufficient to press the valve 16 against its seat. The valve remains open, thereby preventing any drop of pressure inside the volume V2 which could brake the moving equipment.

The current is interrupted on its first zero crossing by the blast produced between the arcing contacts by the gas in the volume V1.

(3) Closing the circuit breaker

The increase in pressure in the volume V2 is sufficient to close the valve 16, but this increase in pressure remains limited because of the large value of the volumes V1 and V3, so the motion of the moving equipment when closing the circuit breaker is not braked significantly.

The circuit breaker described above is capable of interrupting large value currents at medium tension while requiring only a small quantity of operating energy.

We claim:

1. A medium tension circuit breaker having a dielectric blast gas, the circuit breaker comprising a cylindrical insulating casing filled with dielectric gas under pressure, a fixed main contact, a fixed arcing contact, a fixed blast piston, and moving equipment connected to an operating member and comprising a moving main contact, a moving arcing contact, and a blast cylinder associated with a blast nozzle, wherein the circuit breaker includes a drive piston whose section is not less than 1.3 times the section of said blast piston, said drive piston moving relative to a second cylinder.

2. A circuit breaker according to claim 1, wherein the said drive piston is provided with openings closable by a valve disposed on the side of the piston facing the blast cylinder.

3. A circuit breaker according to claim 1, wherein the said drive piston is pierced by calibrated orifices.

4. A circuit breaker according to claim 1, wherein the said blast cylinder includes a first portion fixed to the moving equipment and carrying the said nozzle and co-operating with a fixed second portion sliding in said first portion, in electrical connection therewith via sliding contacts, said second portion carrying said blast piston which is provided with a non-return valve allowing gas to flow only from the outside towards the inside of said blast cylinder.

5. A circuit breaker according to claim 4, wherein said blast cylinder is annular in section and is internally delimited by a metal tube which is coaxial therewith, having a first end constituting the moving arcing contact and having a second end which is connected to the operating member of the circuit breaker.

6. A circuit breaker according to claim 5, wherein the said tube is provided with large-sized holes putting the arcing zone into communication with the said second cylinder relative to which the said piston moves.

7. A circuit breaker according to claim 1, wherein the said drive piston comprises a valve associated with a seat pierced by orifices of calibrated diameter.

* * * * *